United States Patent [19]

Davidson

[11] Patent Number: 4,993,175

[45] Date of Patent: Feb. 19, 1991

[54] SOLEPLATE STEAM SLOT ARRANGEMENT

[75] Inventor: William E. Davidson, Trumbull, Conn.

[73] Assignee: Black & Decker, Inc., Newark, Del.

[21] Appl. No.: 231,367

[22] Filed: Aug. 12, 1988

[51] Int. Cl.[5] ..... D06F 75/38

[52] U.S. Cl. ..... 38/93

[58] Field of Search ..... 38/93, 77.8, 77.81, 38/77.82, 77.83, 77.9

[56] References Cited

U.S. PATENT DOCUMENTS

| | | | |
|---|---|---|---|
| 1,683,145 | 9/1928 | Slonaker | 38/77.8 X |
| 2,078,061 | 4/1937 | Cooper | 38/77.82 |
| 2,333,693 | 11/1939 | Sussman . | |
| 2,344,098 | 3/1944 | Lucia | 38/77.9 |
| 2,347,588 | 4/1944 | Wolcott . | |
| 2,987,839 | 6/1961 | Tavender | 38/77.9 |
| 3,263,350 | 8/1966 | Abraham | 38/77.7 |
| 4,233,763 | 11/1980 | McMullen | 38/93 X |
| 4,658,520 | 4/1987 | Henneberger | 38/93 |
| 4,665,637 | 5/1987 | Kramer | 38/93 |

FOREIGN PATENT DOCUMENTS 681572 10/1952 United Kingdom .

*Primary Examiner*—Andrew M. Falik
*Attorney, Agent, or Firm*—Barry E. Deutsch

[57] ABSTRACT

A soleplate for a steam iron includes steam openings spaced a predetermined minimum distance from its perimeter to avoid lost steam from escaping. In a preferred embodiment, the steam openings include at least one longitudinal slot centrally aligned between lateral edges of the soleplate surface. The maximum width of the slot is limited so as to avoid permitting an edge of fabric from entering. The slotted shape of the steam opening reduces lint cutting and helps avoid stain spots. Other shapes of steam openings are disclosed.

6 Claims, 6 Drawing Sheets

SOLEPLATE STEAM SLOT ARRANGEMENT

BACKGROUND OF THE INVENTION

The present invention relates to housewares and, more particularly, to electric steam irons.

Electric steam irons emit steam from openings in a soleplate first to relax, and then to flatten, a fabric. In the past, it was widely believed that the more steam, and the more widely dispersed the distribution of the steam from the soleplate, the better the flattening effect. To this end, sole plates for steam irons have customarily been made with a large number of steam openings. In most cases, the openings have been distributed about the perimeter, as well as in the center of the sole plate. The belief that a large number of widely distributed steam openings was beneficial was so firmly held that at least one manufacturer of steam irons advertised that its steam irons had more openings than did those of the competition.

I have discovered that the above conventional practices are the result of serious misguidance as to the manner in which steam irons function.

It turns out that a steam is most effective for flattening a fabric when it is applied to the fabric at as cool a temperature as possible and then is completely vaporized by contact with, or proximity to, the hot surface of the soleplate before the sole plate leaves the area of the fabric infiltrated by the steam. Any steam that remains unvaporized when the soleplate moves away tends to increase rumpling or wrinkling of the fabric, rather than flatten the fabric.

I have discovered that the perimeter of a soleplate opening, even when it is well finished, acts as a cutting edge to produce lint from the fabric being ironed. Besides contributing to the wear of the fabric, such lint tends to enter the openings where it becomes charred over time by the high temperature to which it is exposed. Some steam irons experience an occasional expulsion of excess water through the steam openings. When charred lint is present in the soleplate, such excess water can deposit the brown charred lint onto the fabric, staining it. The more openings that exist in a soleplate, the greater is the total area of such openings. Accordingly, the greater the number of steam openings, the greater is the amount of lint produced, and the greater the tendency toward brown spotting.

The task of flattening fabric is made easier for the user when the iron passes over the fabric with minimum drag. Smoothness resulting from minimum drag is called glidability. A smooth finish on the surface of the soleplate improves glidability. However, I discovered that the number and orientation of steam openings also have an important effect on glidability. This effect appears to have been overlooked in the prior art.

OBJECTS AND SUMMARY OF THE INVENTION

Accordingly, it an object of the invention to provide a soleplate for a steam iron which overcomes the drawbacks of the prior art.

It is a further object of the invention to provide a soleplate for a steam iron having a reduced tendency to produce stain spots on a fabric.

It is a still further object of the invention to provide a soleplate for a steam iron having an improved steam distribution for reducing an amount of unvaporized steam escaping the edges of the soleplate.

It is a still further object of the invention to provide a soleplate for a steam iron wherein steam openings are spaced from a perimeter thereof a distance sufficient to ensure complete vaporization of substantially all of the steam before the soleplate is moved away from an area at normal ironing speed.

Briefly stated, the present invention provides a soleplate for a steam iron including steam openings spaced a predetermined minimum distance from its perimeter to prevent lost steam from escaping. In a preferred embodiment, the steam openings include at least one longitudinal slot centrally aligned between lateral edges of the soleplate surface. The maximum width of the slot is limited so as to avoid having an edge of fabric from gaining entrance thereinto. The slotted shape of the steam opening reduces lint cutting and helps avoid the formation of stain spots. Other shapes of steam openings are disclosed.

According to an embodiment of the invention, there is provided a soleplate for a steam iron comprising: a generally planar soleplate surface, at least one steam slot in the soleplate surface, the at least one slot having a width, a forward end and a rear end, the at least one steam slot being laterally centered in the soleplate surface, with it axis parallel to a forward-backward axis of the soleplate, the steam slot including means for preventing an entry therein of an edge of a fabric, and a nearest approach of the at least one steam slot to a perimter of the soleplate being at least great enough to limit lost steam over at least 180 degrees of direction of linear motion. The forward end of the slot is axially closer to a forward edge of the soleplate relative to the position of the rear end of the slot with respect to a rear edge of said soleplate and relative to the position of the sidewalls of the slot with respect to a side edge of said soleplate.

According to a feature of the invention, there is provided a steam iron including a soleplate, the soleplate comprising: a generally planar soleplate surface, at least one steam slot in the soleplate surface, the at least one slot having a width, a forward end and a rear end, the at least one steam slot being laterally centered in the soleplate surface, with its axis parallel to a forward-backward axis of the soleplate, the steam slot including means for preventing an entry therein of an edge of a fabric, and a nearest approach of the at least one steam slot to a perimter of the soleplate being at least great enough to limit lost steam over at least 180 degrees of direction of linear motion.

According to a further feature of the invention, there is provided a soleplate for an electric iron comprising: a generally planar soleplate surface, a plurality of steam openings in the soleplate surface, the steam openings being all disposed in a line laterally centered in the soleplate surface with an axis of the line parallel to a forward-backward axis of the soleplate, and a nearest approach of any of the steam openings to a perimeter of the soleplate being at least great enough to limit lost steam over at least 180 degrees of direction of linear motion.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

It is recognized that steam is generated and delivered to soleplate openings in steam irons in a number of different ways. Besides electrically heated steam irons, wherein steam is generated within the iron, it is also conventional, particularly in commercial installations, to deliver steam from a steam source external to the iron through steam openings in the soleplate of the iron. In this case, the steam is delivered to the iron through a flexible tube. The present invention is indifferent to the manner or location in which the steam is generated. For concreteness of disclosure, however, the invention is described in the environment of an electric steam iron. It should be understood that the insight gained from the present disclosure has utility in any type of steam iron.

Figure 1:
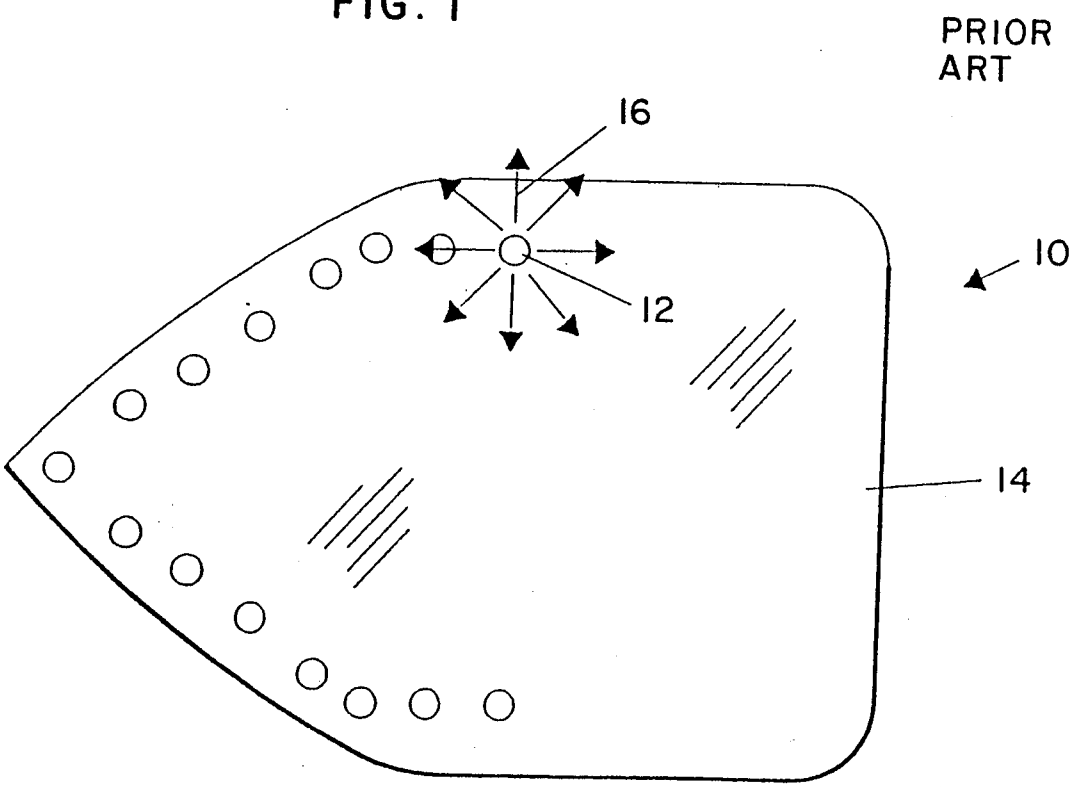
FIG. 1 is view of a soleplate of an electric steam iron according to the prior art.

Referring to FIG. 1, there is shown, generally at 10, a soleplate of a conventional electric steam iron, not otherwise shown. A plurality of steam openings 12 are disposed in a wide array on a soleplate surface 14. It is conventional to place at least some, and in many conventional soleplates 10, most, of steam openings 12 near a perimeter. A plurality of arrows 16 indicate directions in which soleplate 10 may move with respect to a particular one of steam openings 12. If instantaneous motion of soleplate 10 is in a direction indicated by the upward-pointing arrow 16, then any steam emitted must remain under soleplate surface 14 until the opposite edge of soleplate surface 14 passes over the area. Conversely, if instantaneous motion of soleplate 10 is downward in the figure, any steam emitted in the direction of arrow 16 almost immediately finds itself beyond the perimeter of soleplate surface 14. Such steam is hereinafter identified as lost steam.

Lost steam has the exact opposite effect to that desired. That is, it tends to cause a fabric to rumple or wrinkle, rather than flatten. For a given steam temperature, steam delivery rate and temperature of soleplate surface 14, a predetermined minimum residence, or dwell, time is required for steam emitted from a steam opening 12 between a fabric and soleplate surface 14 in order to render it fully dry and for the desired flattening effect to take place. I have discovered that saturated steam (steam at, or just above the boiling temperature of water) condenses in the fabric and is fully evaporated within about one second for usual steam conditions and a temperature of soleplate surface 14 on the order of 125 to 275 degrees C.

It will be clear to one skilled in the art that the residence time depends on the distance between a steam opening 12 and the perimeter of soleplate surface 14 in a direction opposite to that of motion of soleplate 10, and on the speed with which soleplate 10 is being moved over a fabric. With an array of steam openings 12 such as shown in FIG. 1, wherein a substantial number of steam openings 12 are near the perimeter of soleplate surface 14, even very slow motion of soleplate 10 cannot avoid a substantial percentage of steam becoming lost steam trailing behind soleplate 10. A substantial portion of such lost steam condenses on the surface of the fabric being ironed, thereby permitting the fabric to relax and become rumpled.

Figure 2:
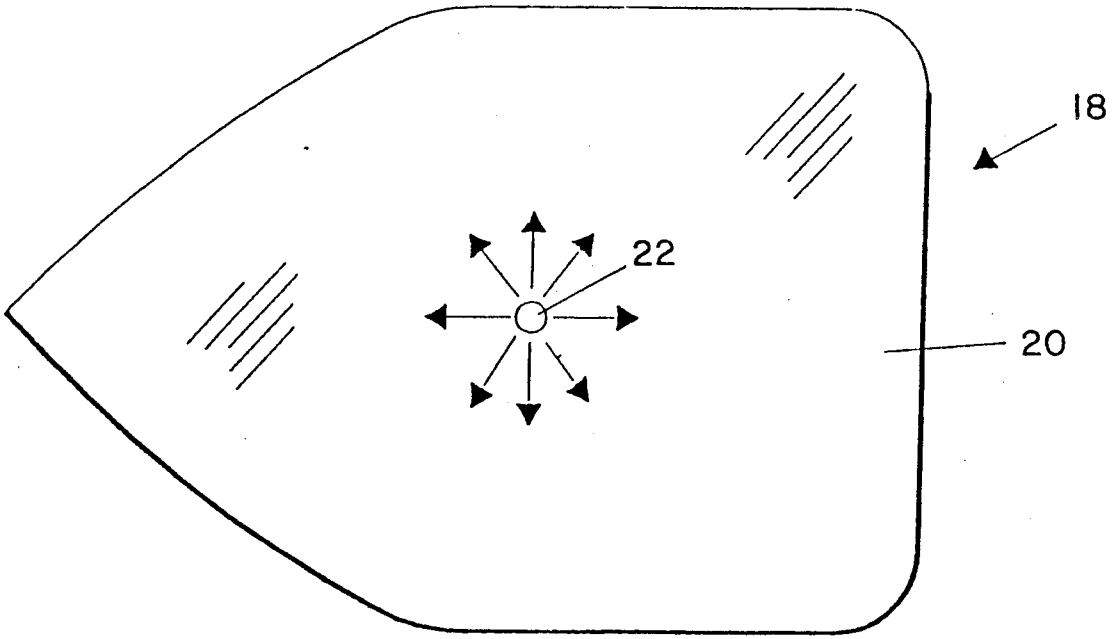
FIG. 2 is a view of a soleplate according to an embodiment of the invention.

Referring now to FIG. 2, there is shown, generally at 18, a soleplate having a single steam opening 22 centrally disposed therein, according to an embodiment of the invention. Such positioning of a single steam opening 22 ensures that a substantial amount of heated soleplate surface 20 surrounds any point at which steam may be emitted. A conventional soleplate surface 20 may be about five inches wide. Its length is substantially greater. Thus, ignoring the width of steam opening 22, at least 2.5 inches of heated metal is disposed between steam opening 22 and the perimeter of soleplate surface 20. If the required residence time for complete drying is about 1.0 second, then an ironing speed of about 5 inches per second is required before permitting unvaporized steam to escape from the perimeter of soleplate surface 20. It develops that 5 inches per second can substantially exceed an ironing speed that an average consumer employs. Accordingly, the central placement of a single steam opening 22 solves the problem of lost steam, when used by the average consumer.

A single circular steam opening 22, however, distributes steam under less than an optimum area of soleplate surface 20 to provide the best pressing.

Figure 3:
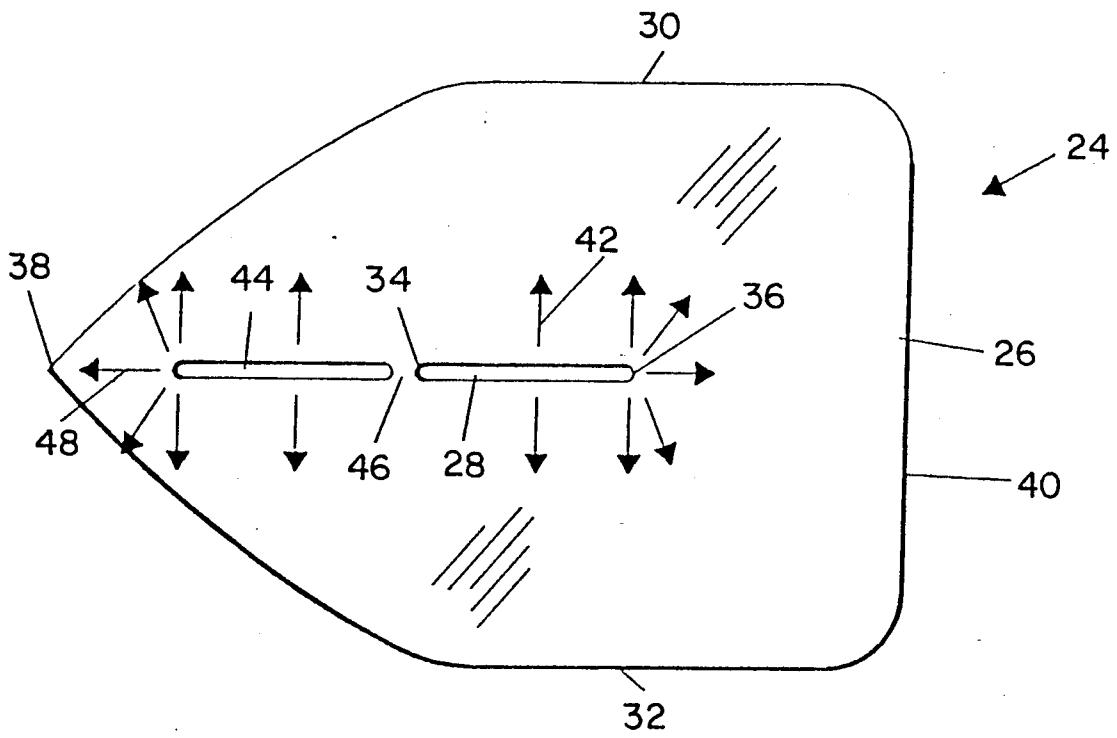
FIG. 3 is a view of a soleplate according to a further embodiment of the invention.

Referring now to FIG. 3, a soleplate 24, according to an embodiment of the invention, includes a soleplate surface 26 having at least one steam slot 28, transversely centered between first and second lateral edges 30 and 32 of soleplate surface 26. A forward end 34 and a rear end 36 of steam slot 28 are far distant from a front 38 and a heel 40, respectively, of soleplate 24. Any steam emitted from steam slot 28 has a residence time under soleplate surface 26 that is long enough to permit complete vaporization thereof before it can reach the perimeter of soleplate 24.

Although not precisely correct, for present purposes, it is sufficient to assume that, when steam is emitted from steam slot 28, it remains stationary at the point of emission. When soleplate 24 is moved, the stationary steam is contacted by the hot soleplate surface 26. Such motion is indicated by a plurality of arrows 42 surrounding steam slot 28.

An additional steam slot 44 is centrally disposed forward of steam slot 28, with a relatively narrow solid portion 46 between them. It will be noted that a forward end 48 of steam slot 44 is relatively close to front 38, as well as to lateral edges 30 and 32 to deliver steam toward the nose of the iron.

One skilled in the art will recognize that the length of time that a quantum of steam spends between a fabric being ironed and soleplate surface 26 depends both on the distance from steam slot 28 to the perimeter of soleplate surface 26, and on the speed with which soleplate 24 is moved. If the combination of distance and speed shortens the residence time below a value giving complete vaporization, then lost steam escapes from beneath soleplate 24, thereby compromising flattening of the fabric.

The residence time of steam under soleplate 24 varies directly with the distance between steam slot 28 or steam slot 44 to the perimeter of soleplate surface 26 divided by the speed with which soleplate 24 is moved. Also, the speed with which soleplate 24 is moved may somewhat vary from user to user. As a consequence, the residence time may also vary from user to user. Within reasonable accuracy, however, the ironing speed for the average user can be characterized for all directions of motion. As will be detailed hereinafter, the physiology of the average user and the average user's normal practices with a steam iron produce different speeds in different directions. Advantage is taken herein of such direction-related speeds in the embodiment of the invention shown in FIG. 3.

Figure 4:
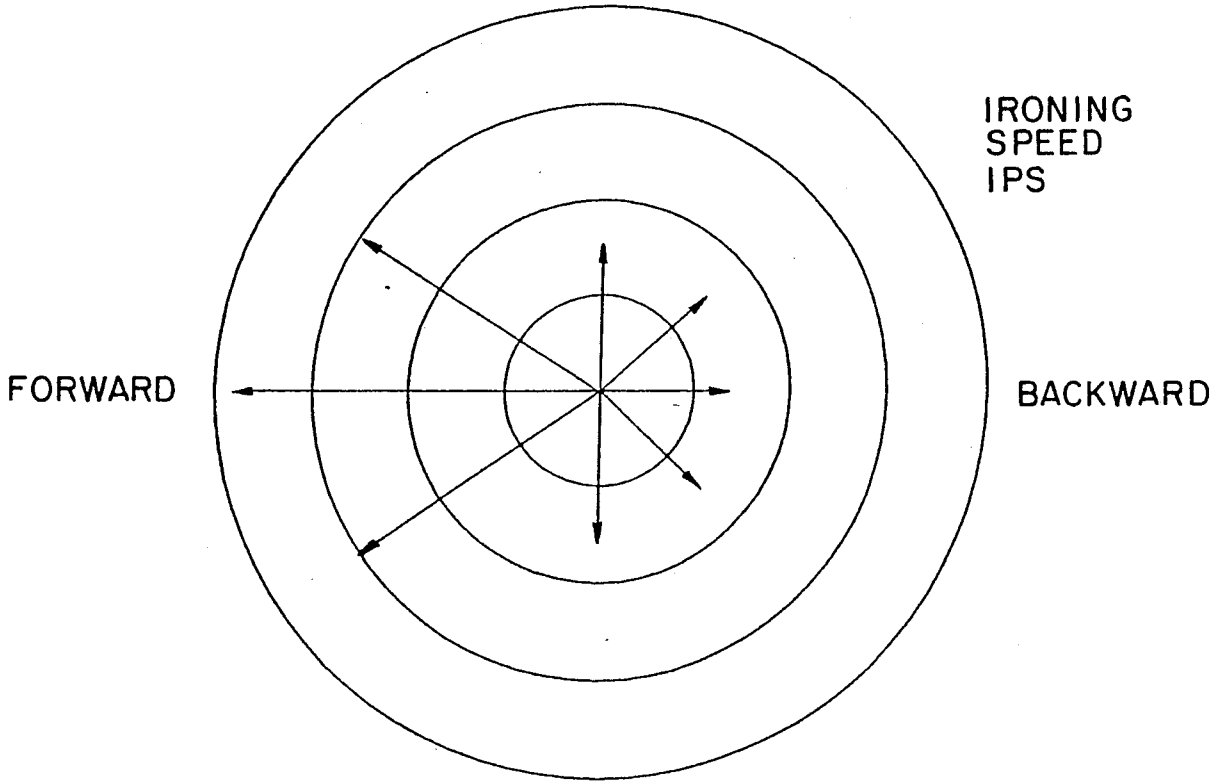
FIG. 4 is a polar plot showing average ironing speeds for normal users.

Referring now to FIG. 4, a polar plot is shown of ironing speeds for an average user. User physiology dictates the biceps muscles in the user's arm is principally involved in producing motion in the forward direction. The biceps, being the strongest muscles in the arm, produce the highest ironing speed in that direction. Much weaker muscles are employed for producing backward motion and even weaker ones still for producing side motion. Ironing speeds are reduced accordingly in these directions.

Returning now to FIG. 3, it will be noted that, although forward end 48 of steam slot 44 is disposed relatively closely to front 38, and to lateral edges 30 and 32, backward and side motions of soleplate surface 26, required to uncover lost steam in these directions, are normally much slower than those in the forward direction, required to uncover lost steam from rear end 36 of steam slot 28. Accordingly, it is permissible to continue steam slot 44 closer to front 38 and lateral edges 30 and 32 than to rear edge 36, without permitting an excessive amount of lost steam for the average user.

In one embodiment of the invention, forward end 48 is spaced about one inch from front 38. The closest approach of forward end 48 to lateral edges 30 and 32 is about 0.7 inch in a direction about 45 degrees from a forward direction. It turns out that the muscles combining to produce motion in the opposite direction to the latter direction are among the weakest in the arm. Thus, lost steam is unlikely to be a significant problem to a normal user. It is believed that the embodiment of the invention whose details are specified in this paragraph experiences less than 2 percent lost steam for any direction of motion of its soleplate and experiences substantially zero lost steam for all directions of motion more than 50 degrees from directly rearward. Thus, through a range of at least 260 degrees motion the soleplate of the present invention produces substantially zero lost steam.

A further factor improves the performance of soleplate 24 with respect to lost steam. Even if a small amount of lost steam occurs during rearwardquarter motion, most users of a steam iron are inclined to finish the flattening of a fabric with a forward motion. Thus, any negative effect of lost steam from generally rearward motion is overcome by the natural tendency of a user to finish with forward motion.

The maximum widths of steam slots 28 and 44 are critical. If the widths are too great, the edge of a fabric can enter and become rolled or creased. This is, of course, not desirable. The minimum widths are governed by steam-flow capacity. That is, for given lengths of steam slots 28 and 44, at least a certain minimum width is required to permit an adequate flow of steam to pass therethrough. The combined overall lengths of steam slots 28 and 44 are as great as possible for good steam distribution, but the maximum is governed by the avoidance of lost steam, discussed in the foregoing. In one embodiment, steam slots 28 and 44 are about 0.1 inch wide, steam slot 44 is about 2.25 inches long, steam slot 28 is about 2.0 inches long and solid portion 46 is about 0.25 inch. Other factors such as, for example, placement of internal components, may require varying the dimensions or locations of steam slots 28 and 44 from the in-line positions shown.

The drag, or reduced glidability, produced by a steam opening is largely due to the amount of downstream edge it presents to the fabric. A round steam opening has a downstream edge approximating its diameter. In the case of steam slots 28 and 44, however, the amount of downstream presented to the fabric depends on the direction of motion. When soleplate motion is parallel to the longitudinal axis of steam slots 28 and 44, the downstream edge is equal to the width of steam slots 28 and 44. The lateral edges of steam slots 28 and 44, being parallel to soleplate motion, effect substantially no drag. When soleplate motion is at right angles to the longitudinal axis of steam slots 28 and 44, the drag is contributed by the entire length of steam slots 28 and 44. Thus, for a width of steam slots 28 and 44 of about 0.1 inch and a length of about 1.5 inch, the contribution to drag of steam slots 28 and 44 is 15 times as great for transverse motion as it is for forward and backward motion.

Although the drag or reduced glideability from steam slots varies with direction of soleplate motion, even in the most draggy direction of motion the drag contribution of steam slots 28 and 44 is no worse than a typical prior-art steam iron having a large number (as many as 45) round or oval steam openings in its soleplate. Indeed, the drag in transverse directions contributed by steam slots 28 and 44 is usually less than that for a typical prior-art steam iron. It is a fact, however, that the average user of a steam iron has a preferred ironing axis generally aligned with the longitudinal axis of the steam iron. Since this preferred ironing axis is aligned with the axis of steam slots 28 and 44, most ironing takes advantage of the improved glidability offered by the long and narrow shape of steam slots 28 and 44.

In some applications, it may be desirable to employ steam slots having other than exactly parallel sides. Such embodiments (not shown) should be considered to fall within the spirit and scope of the invention.

Figure 5:
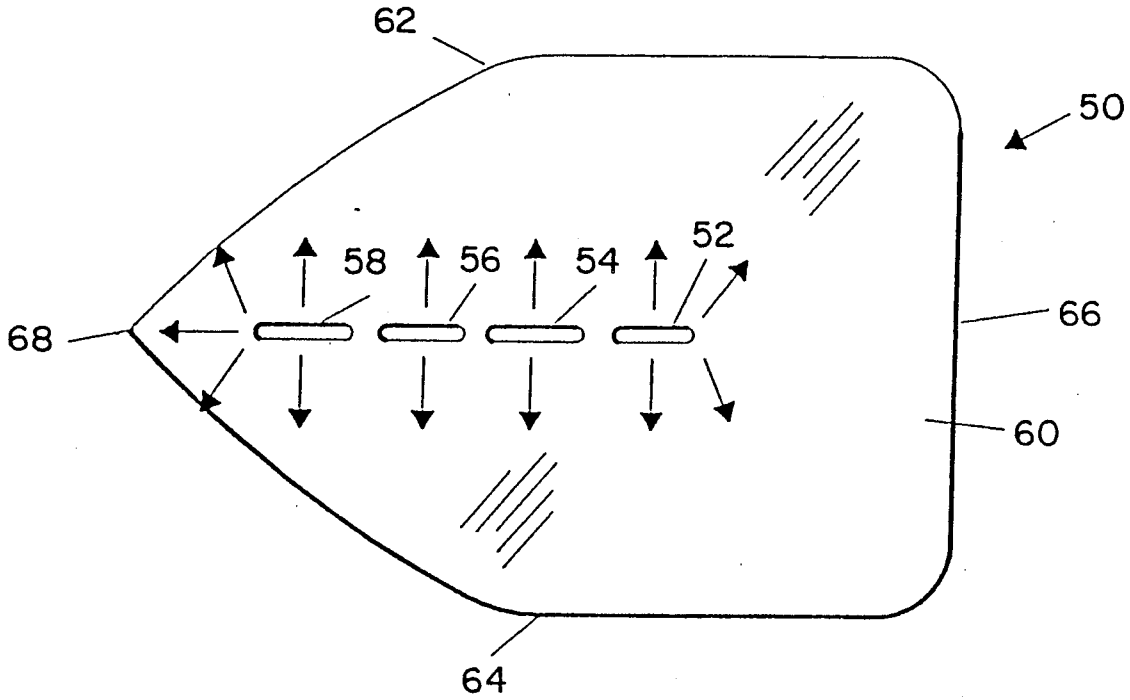
FIG. 5 is a view of a soleplate according to still another embodiment of the invention.

Referring now to FIG. 5, there is shown, generally at 50, a soleplate according to a further embodiment of the invention. In this embodiment, the two steam slots of FIG. 3 are replaced with four steam slots 52, 54, 56 and 58, along the aligned longitudinal axis in a soleplate surface 60. The relationships between steam slots 52, 54, 56 and 58 with lateral edges 62 and 64 and heel 66 and front 68 are as described in the foregoing.

Figure 6:
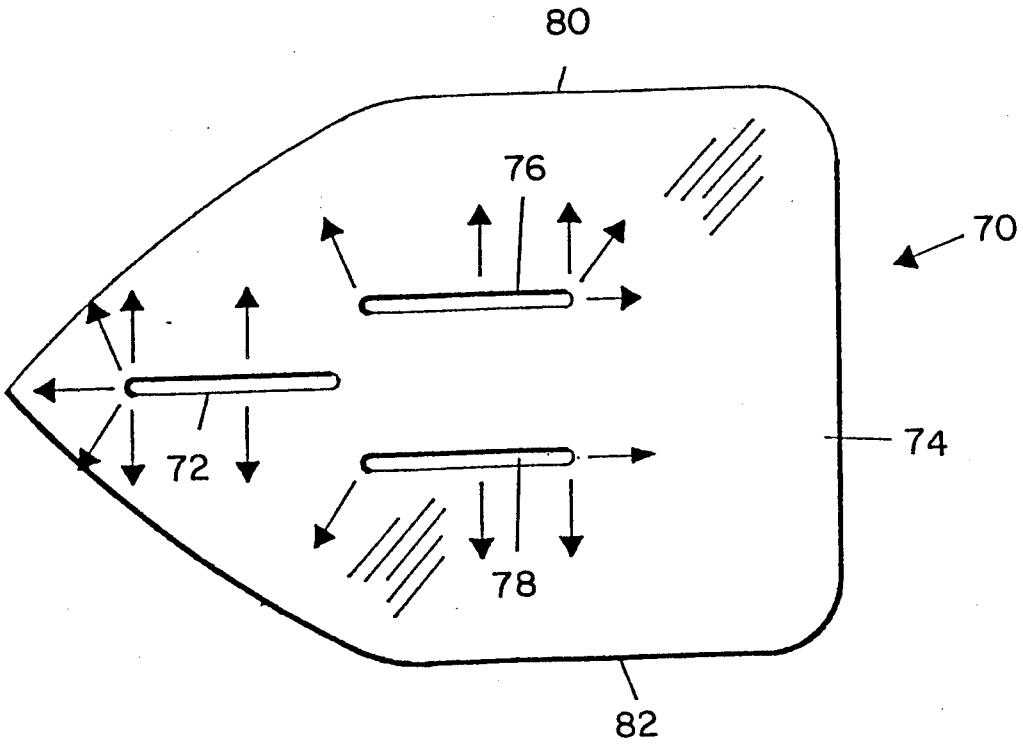
FIG. 6 is a view of a soleplate according to another embodiment of the invention.

Referring now to FIG. 6, there is shown, generally at 70, a soleplate according to a further embodiment of the invention. A need to place steam slots in locations where they avoid internal components (not shown) may make it desirable to move the rearward steam slot off the centerline of soleplate 70. In addition, some applications make it desirable to distribute at least some steam at laterally displaced locations. Accordingly, a single forward steam slot 72 is disposed in a soleplate surface 74 as previously described. First and second parallel rear steam slot 76 and 78 are offset radially from a longitudinal centerline of soleplate surface 74. The distances between steam slot 76 and 78, and their adjacent lateral edges 80 and 82, respectively, are governed by the principles of avoiding lost steam as described in the foregoing.

I have discovered that the use of one, or at most a few, steam slots, rather than more numerous round or oblong steam holes, results in reduced lint cutting and a corresponding reduction in the possibility of spotting. Referring again to FIG. 3, part of the benefit appears to derive from the interaction of normal ironing motion and the slotted shapes of steam slots 28 and 44. The predominant motion for most users is forward and backward. Side-to-side motion is less frequent. The lateral edges of steam slots 28 and 44 do not tend to cut lint in forward and backward motion; only a small tendency toward cutting is produced as rear end 36, forward end 48 and the ends of the slots adjacent to solid portion 46 pass over an area of a fabric. Accordingly, the cutting tendency for a given steam-emission area is greatly reduced.

Although the slotted shapes are critical from the standpoint of lint cutting, the same is not true from the standpoint of avoiding lost steam. Accordingly, the slots in the embodiments described above could be replaced by round, oval, square, or otherwise shaped openings, provided the distances to the perimeter of the soleplate surface are obeyed for avoidance of lost steam.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A metal soleplate for a steam iron for pressing and drying a fabric comprising:

a generally planar soleplate surface;

at least one steam slot in said soleplate surface;

spaced sidewalls defining therebetween the width of the slot said at least one slot having a forward end and a rear end, with the forward end of said slot being axially closer to a forward edge of said soleplate relative to the position of the rear end of the slot with respect to a rear edge of said soleplate and relative to the position of the sidewalls of the slot with respect to a side edge of said soleplate.

said at least one steam slot being laterally centered in said soleplate surface, with an axis thereof disposed parallel to a forward-backward axis of said soleplate;

said steam slot including means for preventing an entry therein of an edge of the fabric, said means for preventing including said width being less than a predetermined value of about 0.1 inch; and a nearest approach of said at least one steam slot to a perimeter of said soleplate being at least great enough to limit lost steam over at least 180 degrees of direction of linear motion of the soleplate relative to the fabric.

2. A metal soleplate for an electric iron for pressing and drying a fabric comprising:

a generally planar soleplate surface; a plurality of steam openings in said soleplate surface;

all of said steam openings being disposed in a line laterally centered in said soleplate surface with an axis of said line parallel to a forward-backward axis of said soleplate; and a nearest approach of any of said steam openings to a perimeter of said soleplate being at least great enough to limit lost steam over at least 180 degrees of direction of linear motion of the soleplate relative to the fabric.

3. A soleplate according to claim 2, wherein said at least 180 degrees including at least 260 degrees.

4. A soleplate according to claim 3 wherein said nearest approach is great enough to limit lost steam to no more than two percent at normal ironing speeds speeds for movement of the iron relative to the fabric.

5. A metal soleplate for a steam iron for pressing and drying a fabric comprising:

a generally planar soleplate surface;

at least one steam slot in said soleplate surface, said one steam slot including a first steam slot laterally centered in said soleplate surface;

spaced sidewalls defining therebetween the width of the slot, said at least one slot having a forward end and a rear end, with the forward end of said slot being axially closer to a forward edge of said soleplate relative to the position of the rear end of the slot with respect to a rear edge of said soleplate and relative to the position of the sidewalls of the slot with respect to a side edge of said soleplate;

said at least one steam slot being laterally centered in said soleplate surface, with an axis thereof disposed parallel to a forward - backward axis of said soleplate;

said steam slot including means for preventing an entry therein of an edge of the fabric;

a nearest approach of said at least one steam slot to a perimeter of said soleplate being at least great enough to limit lost steam over at least 180 degrees of direction of linear motion of the soleplate relative to the fabric;

said at least one steam slot including second and third steam slots disposed with axis thereof parallel to said forward - backward axis;

said second steam slot being longitudinally displaced from said first steam slot along said forward-backward axis;

said second steam slot further being laterally displaced a first distance to a first side of the center line of said soleplate surface;

said third steam slot being parallel to said second steam slot and laterally displaced a second distance to a second opposite side of said center line;

said first and second distances being equal.

6. A soleplate according to claim 5 wherein said nearest approach is not less than 0.7 inch.

* * * * *